United States Patent [19]

Gross

[11] Patent Number: 4,623,013

[45] Date of Patent: Nov. 18, 1986

[54] ADJUSTABLE DRAPE AND ROD ASSEMBLY

[76] Inventor: Gertrude Gross, 150 Liberty Ct., Sidney, Ohio 45365

[21] Appl. No.: 645,033

[22] Filed: Aug. 27, 1984

[51] Int. Cl.[4] ..... A47H 5/00

[52] U.S. Cl. ..... 160/345; 160/330; 160/348

[58] Field of Search ..... 160/330, 340, 341, 344, 160/345, 348, 123, 124, 126; 16/87.4 R, 87.6 R

[56] References Cited

U.S. PATENT DOCUMENTS

| | | | |
|---|---|---|---|
| 2,524,477 | 10/1950 | Robertson et al. | 160/126 |
| 2,757,804 | 8/1956 | Sadwin | 16/87.6 R |
| 2,952,315 | 9/1960 | Brontman | 160/330 |
| 3,033,127 | 5/1962 | Kuebler | 160/126 X |
| 3,082,818 | 3/1963 | Judovits | 160/344 |
| 3,484,892 | 12/1969 | Hachtel | 160/345 X |
| 3,951,197 | 4/1976 | Cohen et al. | 160/346 |
| 4,034,439 | 7/1977 | Kohne | 160/345 X |
| 4,117,557 | 10/1978 | McPeak et al. | 160/330 X |

*Primary Examiner*—J. Franklin Foss
*Assistant Examiner*—David M. Purol
*Attorney, Agent, or Firm*—Jos. R. Scalzo

[57] ABSTRACT

This invention pertains to a new and useful adjustable and reversible drape and rod assembly that incorporates small hanging rings sewed at or near the seams of folded pleats spaced along the top portion of the drape, which drape then can be easily hung or removed from special movable hanging hooks extending from a specially designed rod and moveable hook holder therein, and sewed on the initial rear side of a drape so that the rings are not visable when viewed from the front. The specially designed moveable hook holders permit each pair of roller wheels to rotate freely around a tubular axle and the axle to rotate freely within both roller wheels and also within the spacer separating the wheels thus permitting improved maximum mobility of the hook holders desirable and necessary for heavier reversible drape and rod assemblies. By the insertion of an open eyelet in the drape immediately above the point at which the hanging ring is sewed to the drape, the drape can be reversed by merely pushing the hanging ring through the eyelet to the other side of the drape so that what was initially the rear of the drape now becomes the front, and the hanging rings remain not visable when viewed from the front.

As will be further disclosed in the specifications, it can be seen that not only is the present adjustable drape and rod assembly simple and economical to make and use, easy to install or remove, secure and certain in operation, non-distructive to the fabric of the material for hanging purposes and non-injurious to the person assemblying and hanging them, and also easily becoming reversible; a combination of important attributes long needed and sought after by drapery designers and manufacturers and particularly the users, normally housewives, who in the final analysis must either make or buy them, but always must install, maintain and remove them.

1 Claim, 6 Drawing Figures

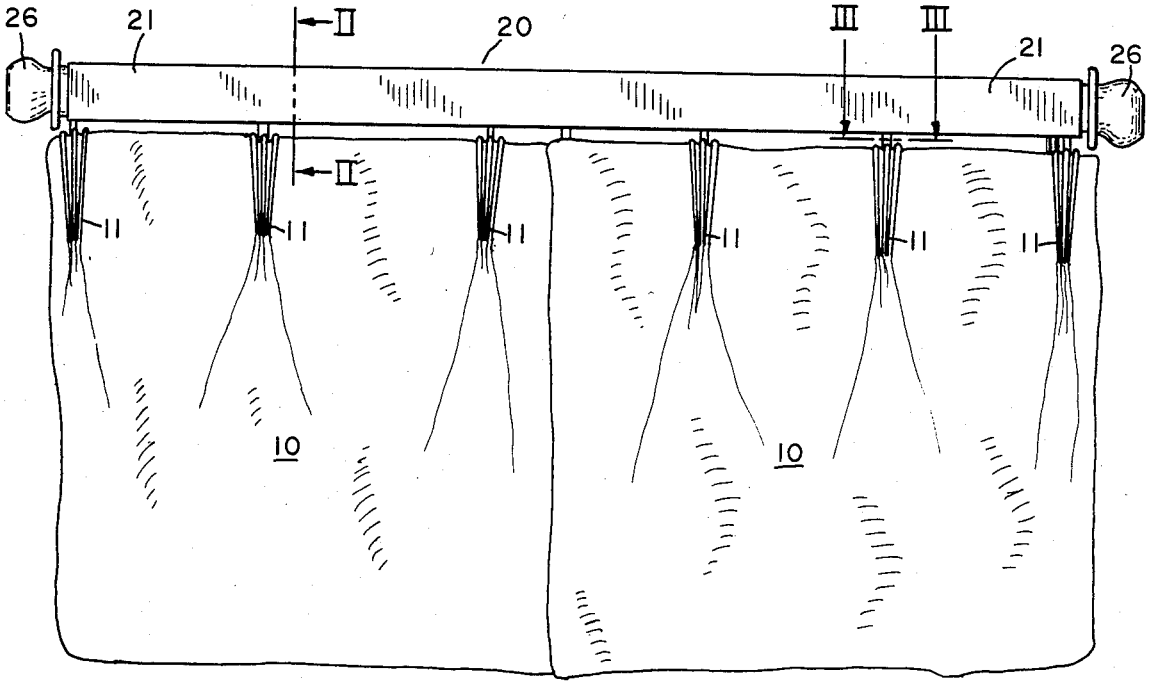
Fig I
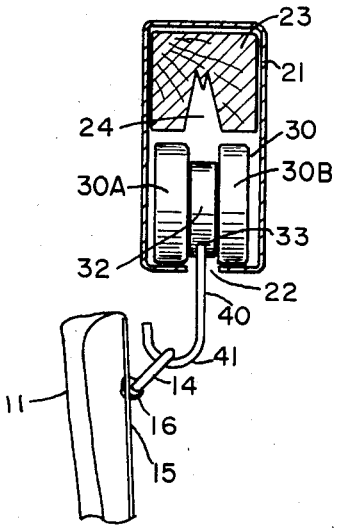
Fig II
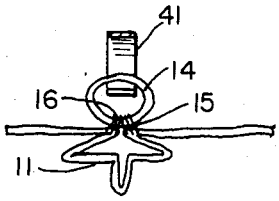
Fig III

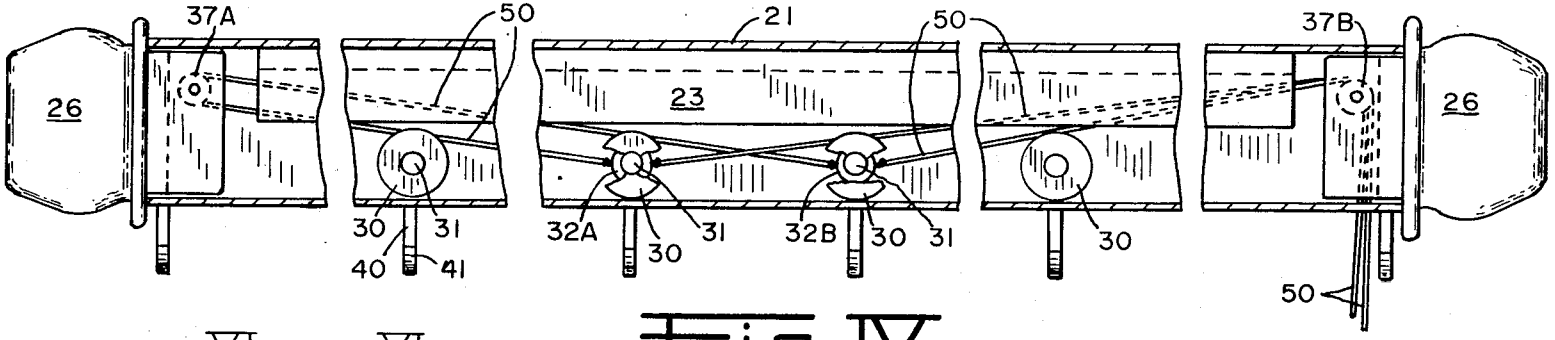
Fig IV
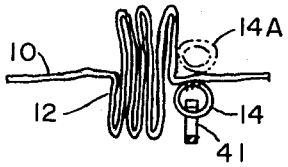
Fig VI
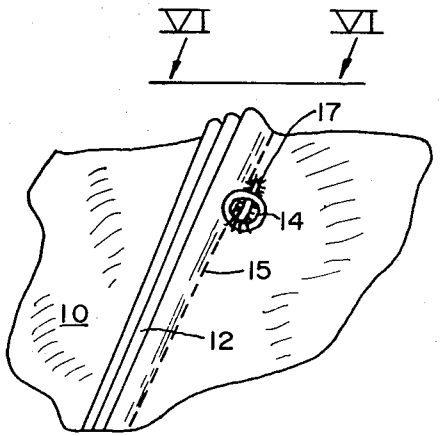
Fig V

ADJUSTABLE DRAPE AND ROD ASSEMBLY

DESCRIPTION

This invention relates to a novel window or wall drape and rod assembly that is not only beautiful to behold but functional in application beyond those now available, and if desired can be made immediately reversible.

Today the use of drapes is a necessity in most modern homes, both for appearance and the practical necessity of closing off windows from outside visibility, sun, cold and heat.

However, to hang drapes particularly on the movable parts now commonly used in drapery rods, and required to permit opening and closing drapes to a desired position, several serious problems normally exist which by the use of the present invention are eliminated. For instance, the normal manner of hanging drapes is to first puncture the fabric of the material by pins or hooks thrust into and through the fabric to secure a holding means on the drape fabric for attaching the pin or hook onto some movable part in a drapery rod used both to hold the hanging drapes and to permit the opening and closing of the drapes.

Several different means and attachments have been devised for doing this. However, most are either cumbersome or impractical or even dangerous to install and use, or have only limited or specialized application. For the most part the present devices now in use are damaging to the material and difficult to not only manufacture but even more difficult and cumbersome to install.

The drapes described in this invention for practical application as well as beauty are specially pleated and sewed at their top. This not only reinforces the rigidity of the top portion of the drape thus keeping it from folding or bending over at the very top, but also affords an opportunity to sew a hanging ring attachment to the sewed seam that forms the pleat and thus not on the main drapery fabric which due to the weight of a hanging drape could, and usually does, rip or tear the fabric when hung after a brief period of normal use.

The hanging problem presented by most drapes and rod assemblies is that not only are the hooking means to drapes difficult and destructive to attach to the drape itself, but it is frequently even more difficult to attach or hook the drapes on to the movable parts of the drapery rod itself with safety and certainty.

The present invention contemplates the incorporation of a drapery rod with specially designed movable hanging hooks that is certain in design, structure and application, particularly when used in combination with the specially designed pleated drapes hanging rings and ring eyelets to make the drapes reversible, which render the entire drape and rod assembly, hereinafter described in detail, an important novel, useful and needed addition to the art of adjustable drape and rod assemblies.

Now referring to the drawings:

FIG. 1 is a front elevation of a rod and drape assembly.

FIG. 2 is a side elevation cut away view of the rod showing the roller hook holder within it and the drape and ring hanging therefrom.

FIG. 3 is a top sectional elevation of one of the rings and drapery pleat sections hanging on the hook.

FIG. 4 is a sectionally reduced view of the rod with the front of the rod removed for description purposes.

FIG. 5 is a perspective view of a pleated drape section with a ring and ring eyelet for making the drape reversible.

FIG. 6 is a top elevation view of a preferred pleated section of a reversible drape.

Now again referring to the drawings for ease of description, you will see in FIG. 1 a combination of a pair of adjustable pleated drapes 10 and drapery rod 20 in a closed hanging position. Only a small drapery rod and drape assembly is shown here for explanatory purposes only; however, larger drapes and rods normally will be employed involving the principals embodied in the present invention.

For purposes of this invention the preferred drapery rod 20 consists essentially of a elongated, rectangular rod casing 21 with a hollow interior and which casing is provided with an open channel 22 on its underside which open channel extends the entire length of the rod casing. The rod casing 21 is open on both its ends; however, for asthetic as well as sealing purposes normally will have removable designed rod end plugs 26. Disposed within the drapery rod casing 21 will be a plurality of movable hook holders 30 that are designed to move laterally along the bottom of the rod casing 21. Each hook holder 30 is designed with an attached hook extension 40 that extends downwardly through the rod casing open channel 22 and is free to move laterally within the open channel 22. The hook extension 40 is designed to terminate in its bottom end portion in a hooked end portion or hook 41. Further description of this preferred drapery rod casing 21 and its hook holders 30 will be described in more detail in other parts of this description.

The preferred drape assembly of this invention consists mainly of a normal flexible drape 10 usually formed of durable fabric that can be pleated along its top portion on one or both sides. The pleats 11 are formed by a gathering and folding of the drape fabric at its top portion in spaced pleated sections 11 along the top of the drape. The pleats are formed and secured as such by means of a sewed seam 15 along the length of the pleat 11. Normally 3 folds will comprise a suitable and preferred pleat. The pleats may be vertical or triangular in shape; however, the sewed seam 15 must extend the entire length of the desired pleat. This gives firmness and rididity to the top portion of the drape to prevent the top portion from falling or bending forward when hung, which is unsightly and to be avoided at all costs, as well as enhancing the beauty of the drape.

Also the sewed seam 15 securing the pleat 11 acts as a stable and secure anchor point 16 for sewing the important hanging ring 14 onto the drape 10 directly on sewed seam 15 or immediately adjacent of it to give a more secure anchor point and to prevent bulging or tearing of the drape fabric if the hanging ring 14 were sewed at any other point on the drape fabric. The hanging ring 14, to be permitted to swing up and down for hooking purposes, is sewed securely to the seam at only one point or spot on the ring as well as the seam.

For the non-reversible drape the preferred pleated sections 11 as shown in FIGS. I, III and V are the preferred pleat configuration which is triangular, wider at the top than at the bottom. However, for a reversible drape, important to the application of the present invention, a vertical section pleat is preferred as shown in FIGS. V and VI.

It is both useful and frequently desirable to install reversible drapes. This is made easy by the use of the present novel means of sewing the hanging ring 14 to the pleated section seam 15 or adjacent to it and then to form an open eyelet 17 adjacent to the hanging ring 14 through which the ring 14 can be pushed to the other side of the drape so that the drape can be reversed, and the ring 14 remain on the back and nonvisible side of the reversible drape. FIG. VI illustrates the preferred pleat and the dual positions of a single ring 14 that are made possible with the combination of the swinging, hanging ring 14 and the open eyelet 17 through which it can be pushed to the other side of the drape to make a drape reversible.

The size of the ring 14 and its sewed anchor position on seam 15 are determined by insuring that in its hanging position on hook 41, the ring 14 and hook 41 should not be visible above the top edge of the drape 10 when viewed from the front.

Now, referring again to the drapery rod assembly, the preferred rod casing 21 which is hollow in its interior and which has an insert top piece 23 with an open chord channel 24 on its underside extending the entire length of the rod casing. The insert open channel 24 permits two sides of the insert 23 to act as upper guides for stabilizing the rolling action of the hook holder rollers or wheels 30A and B.

The hook holder 30 of the preferred embodiment consists of a pair of rollers or wheels 30A and B spaced apart so as to have each wheel roll along opposite sides of the casing channel opening 22 beneath the two sides of the rod top insert piece 23. The two wheels 30A and B are connected by a tubular axle 31 around which the wheels rotate. A circular spacer 32 provided with a central round opening through which the tubular axle 31 passes, is fitted between and maintains the correct separating distance between the wheels 30A and B. The axle 31 is free to rotate within the spacer 32 as well as the wheels 30A and B. The diameter of the circular spacer 32 is less than that of the wheels 30A and B. The hook holder hook extension piece 40 is attached at its top end portion to the underside of spacer 32 and hangs beneath it. The bottom portion of the hook extension 40 is formed into a hook end portion 41 to receive the hanging ring 14 sewed to the pleated section of drape 10 for hanging the drapes.

The mechanics of a preferred adjustable drapery rod and drape assemble is simplified and shown best in FIG. 4.

The hook holders 30 are inserted into the open end of rod casing 21 which when removable end plugs 26 are removed permit easy insertion of the hook holder 30 as shown in FIG. 2.

The action of the pulling chords 50 are permitted to work in normal opening and closing manner by the simple expedience of having one chord anchored to the outside of a spacer 32A between wheels 30A and B and passing over pulley 37A and connecting to the inside of a second spacer 32B. The other chord at one end is anchored to the outside of spacer 32B and to the inside of spacer 32A and passing over pulleys 37B. The pulling chord 50 is permitted to hang as shown in FIGS. I and IV to a desired length to enable the adjusting of the drapes manually with the pulling chord 50.

As can be ascertained from the description herein, the present invention represents a significant improvement in adjustable and reversible drape and rod assemblies.

While variations can be made beyond the disclosures discussed and shown herein and still remain within the purview of this invention, what is now claimed is:

1. An adjustable drape and rod assembly comprising:

a drapery rod consisting of a hollow drapery rod casing the underside of which is provided with an open channel throughout the entire length of said rod casing, a plurality of movable hook holders disposed within said rod casing and each of said hook holders consisting of:

a pair of roller wheels disposed within said rod casing, and each of said roller wheels provided with a central circular opening throughout, a spacer disposed between each of said pair of roller wheels, and said spacer being provided with a circular hollow opening throughout, a tubular axle extending through said circular hollow openings in said spacer and said roller wheels, so that said tubular axle can freely rotate within said spacer and said wheels, and said wheels can freely rotate around said axle permitting maximum rotational mobility to the said movable hook holders, a hook extention attached to and extending downward from each of said spacers, said hook extention extending through said open channel in said rod casing and terminating in a hooked end portion;

a hanging pleated reversible drape, a plurality of sewed, folded pleats spaced along the entire length of the top portion of said drape, and each of said folded pleats being held together by a securely sewed seam along the entire length of said folded pleat, an individual hanging ring sewed at one point only on the rear side on each of said securely sewed seams on each of said sewed folded pleats on said top portion of said drape and each ring being designed to receive and hang from said hooked end portion of said hook extension extending from said movable hook holder upon said rod and the point at which said hanging ring is sewed to said seam on said pleat will be determined by the size of said hanging ring and the length of said hooked extension and said hooked end portion so that when said hooked end portion is hooked within said hanging ring, said hanging ring will remain below the top of said drape and nonvisable when viewed from the front, eyelet openings cut in said drape immediately above the point at which each of said rings are sewn to said pleated seam on said drape top portion and said eyelet openings being sized to permit said hanging rings to be pushed through said eyelet openings to the opposite side of said drape thus making said drape reversible for hanging purposes by permitting said hanging rings to always remain on the rear side of said drape and said hanging rings nonvisable when viewed from the front of said drape.

* * * * *